US011326302B2

(12) United States Patent
Chen et al.

(10) Patent No.: US 11,326,302 B2
(45) Date of Patent: May 10, 2022

(54) STEAM TYPE CLOTHING FLATTENING DEVICE

(71) Applicant: Tsann Kuen (Zhangzhou) Enterprise Co., Ltd., Fujian (CN)

(72) Inventors: Ronghuang Chen, Fujian (CN); Zhenxing Zheng, Fujian (CN); Ruifeng Cai, Fujian (CN); Kaicheng Zheng, Fujian (CN)

(73) Assignee: Tsann Kuen (Zhangzhou) Enterprise Co., Ltd., Fujian (CN)

( * ) Notice: Subject to any disclaimer, the term of this patent is extended or adjusted under 35 U.S.C. 154(b) by 13 days.

(21) Appl. No.: 16/909,369

(22) Filed: Jun. 23, 2020

(65) Prior Publication Data

US 2021/0032798 A1 Feb. 4, 2021

(51) Int. Cl.

| | |
|---|---|
| ***D06F 75/16*** | (2006.01) |
| ***D06F 75/20*** | (2006.01) |
| ***D06F 75/24*** | (2006.01) |
| ***D06F 75/26*** | (2006.01) |
| ***D06F 75/38*** | (2006.01) |

(52) U.S. Cl.

CPC ..... *D06F 75/16* (2013.01); *D06F 75/20* (2013.01); *D06F 75/24* (2013.01); *D06F 75/26* (2013.01); *D06F 75/38* (2013.01)

(58) Field of Classification Search

CPC ..... D06F 75/00

See application file for complete search history.

(56) References Cited

U.S. PATENT DOCUMENTS

| | | | | |
|---|---|---|---|---|
| 3,110,975 | A * | 11/1963 | Kircher | D06F 75/18 38/77.7 |
| 5,883,358 | A * | 3/1999 | Brandolini | D06F 75/38 219/258 |
| 6,802,141 | B2 * | 10/2004 | Walther | D06F 75/38 38/77.83 |
| 9,540,760 | B2 * | 1/2017 | Cai | D06F 75/38 |

(Continued)

FOREIGN PATENT DOCUMENTS

| | | | |
|---|---|---|---|
| CN | 101196288 | A | 6/2008 |
| CN | 201678882 | U | 12/2010 |

(Continued)

OTHER PUBLICATIONS

Search Report appended to an Office Action, which was issued to Chinese counterpart application No. 201910693592.2 by the CNIPA dated Feb. 23, 2022 with an English translation thereof.

*Primary Examiner* — Ismael Izaguirre

(74) *Attorney, Agent, or Firm* — Muncy, Geissler, Olds & Lowe, P.C.

(57) ABSTRACT

A steam type clothing flattening device includes an electrical heating tray unit and a soleplate unit. The electrical heating tray unit is heated electrically to vaporize water in an upper vaporization chamber thereof, and has a discharge port for discharge of vapor from the upper vaporization chamber. The soleplate unit is coupled to an underside of and heated by the electrical heating tray unit. The soleplate unit cooperates with the electrical heating tray unit to define a lower vaporization chamber in communication with the discharge port, and has a plurality of vapor outlets extending through a bottom surface thereof for outletting vapor from the lower vaporization chamber.

6 Claims, 10 Drawing Sheets

(56) References Cited

U.S. PATENT DOCUMENTS

| | | | | |
|---|---|---|---|---|
| 2015/0330014 | A1* | 11/2015 | Mohankuma | D06F 75/14<br>38/144 |
| 2017/0226687 | A1* | 8/2017 | Yagi | D06F 75/24 |

FOREIGN PATENT DOCUMENTS

| | | | |
|---|---|---|---|
| CN | 108425225 | A | 8/2018 |
| EP | 3 156 538 | A1 * | 4/2017 |

* cited by examiner

STEAM TYPE CLOTHING FLATTENING DEVICE

CROSS-REFERENCE TO RELATED APPLICATION

This application claims priority of Chinese Invention Patent Application No. 201910693592.2, filed on Jul. 30, 2019.

FIELD

The disclosure relates to a clothing flattening device, more particularly to a steam type clothing flattening device.

BACKGROUND

A conventional steam type clothing flattening device has only one vaporization chamber for vaporizing water. When the volume of vapor needed is increased, condensation of the vapor happens easily. Current methods implemented in the conventional steam type clothing flattening device to resolve this issue includes increasing heating power supplied to the conventional steam type clothing flattening device, or increasing the quantity of heating tubes to heat a larger region. The first method is limited by the vaporizing surface area of a heating tray of the conventional steam type clothing flattening device, and the second method increases cost drastically.

SUMMARY

Therefore, the object of the disclosure is to provide a steam type clothing flattening device that can alleviate at least one of the drawbacks of the prior art.

According to the disclosure, a steam type clothing flattening device includes an electrical heating tray unit and a soleplate unit.

The electrical heating tray unit is heated electrically to vaporize water in an upper vaporization chamber thereof, and has a discharge port for discharge of vapor from the upper vaporization chamber.

The soleplate unit is coupled to an underside of and heated by the electrical heating tray unit. The soleplate unit cooperates with the electrical heating tray unit to define a lower vaporization chamber in communication with the discharge port, and has a plurality of vapor outlets extending through a bottom surface thereof for outletting vapor from the lower vaporization chamber.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
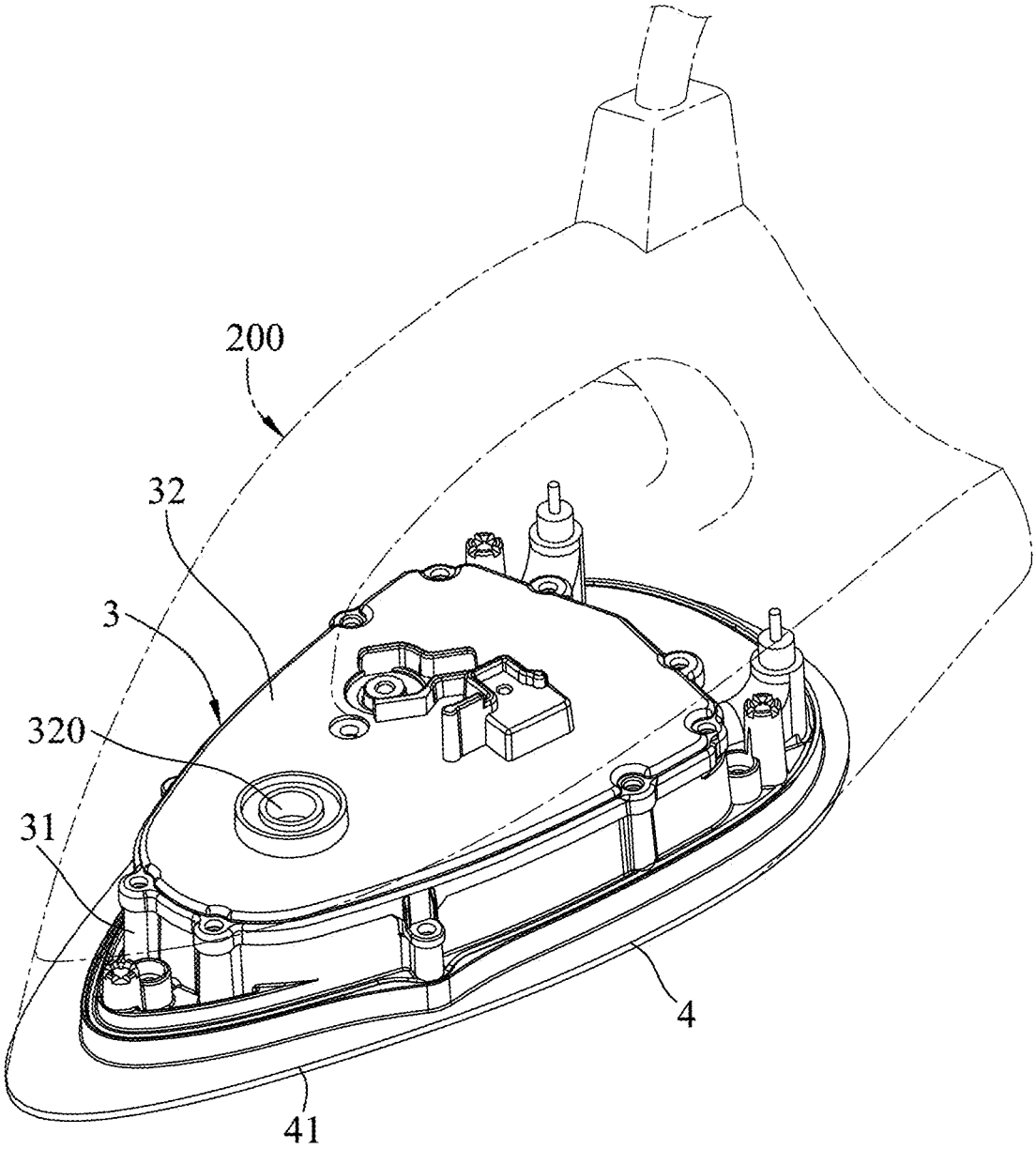
FIG. 1 is a schematic view of a first embodiment of a steam type clothing flattening device according to the disclosure.

Before the present invention is described in greater detail, it should be noted that where considered appropriate, reference numerals or terminal portions of reference numerals have been repeated among the figures to indicate corresponding or analogous elements, which may optionally have similar characteristics.

Figure 2:
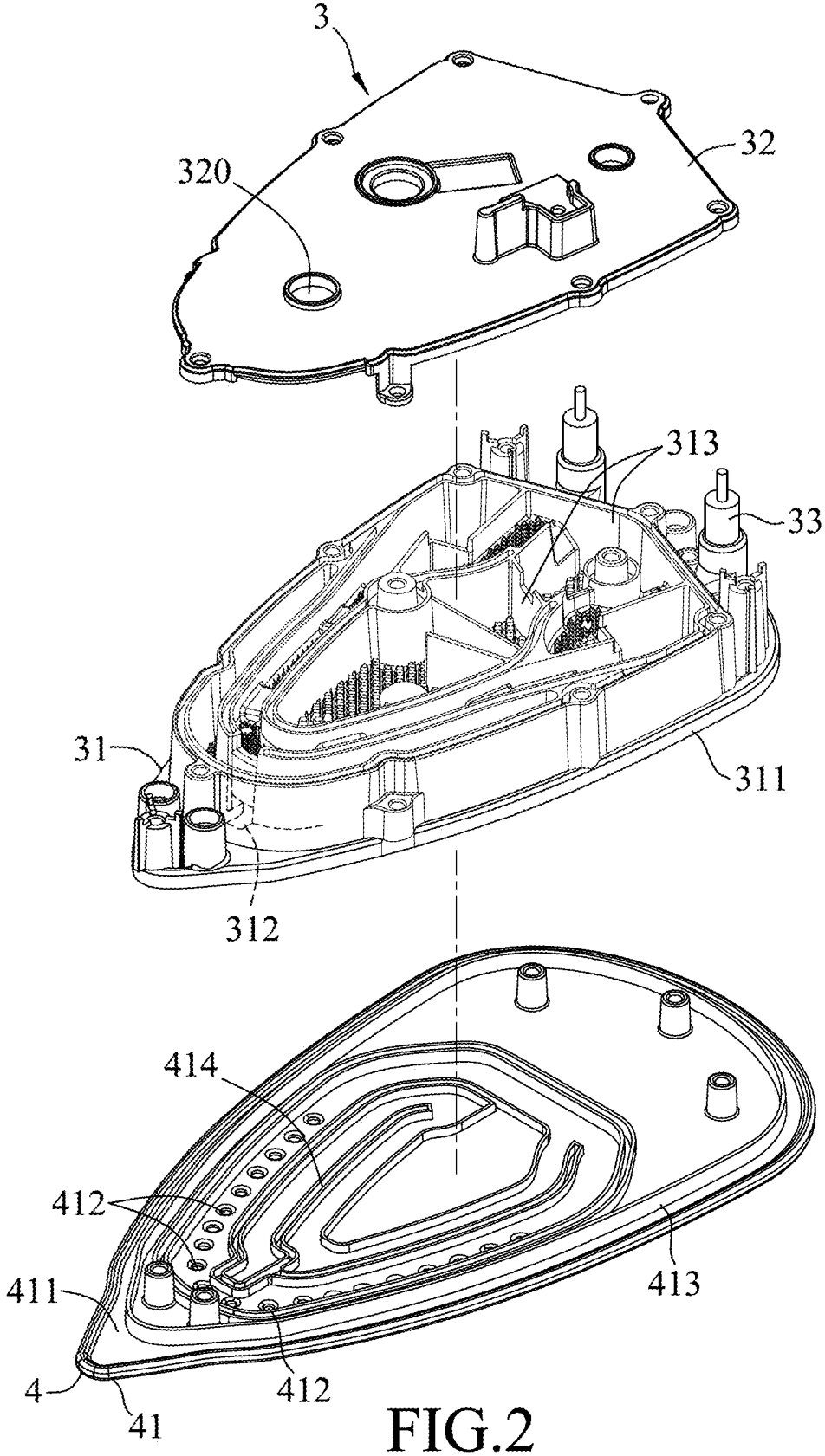
FIG. 2 is an exploded view illustrating an electrical heating tray unit and a soleplate unit of the first embodiment.

Referring to FIGS. 1 and 2, a first embodiment of a steam type clothing flattening device 200 according to the disclosure includes an electrical heating tray unit 3 and a soleplate unit 4 coupled to an underside of and heated by the electrical heating tray unit 3. In this embodiment, the steam type clothing flattening device 200 is exemplified as a steam iron and further includes structures such as a water supply connected to the electrical heating tray unit 3, a steam/temperature adjuster, and electrical control circuitry. Since the inventive features of the disclosure do not reside in these structures, details thereof are omitted for sake of brevity.

Figure 3:
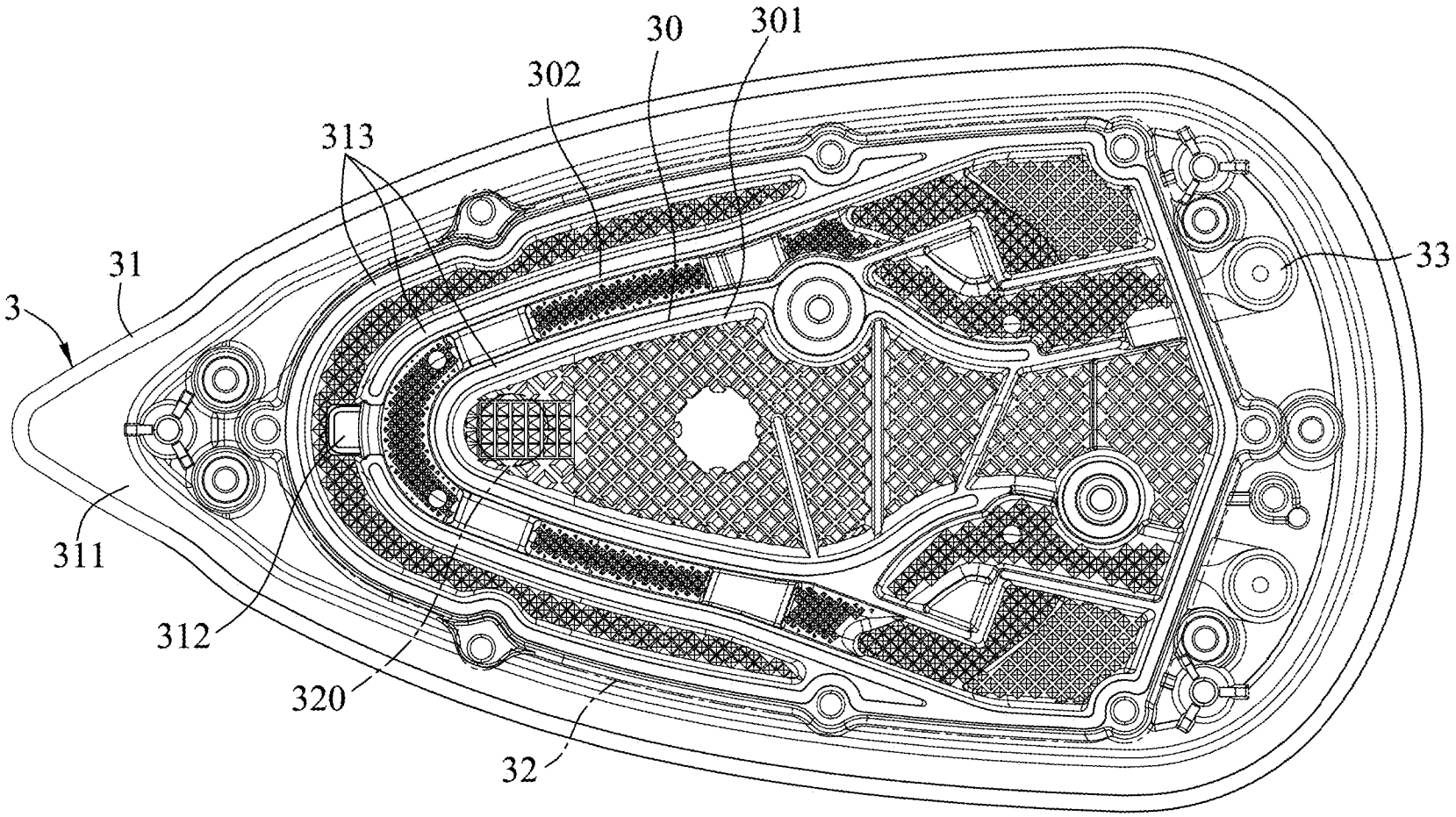
FIG. 3 is a top view of the electrical heating tray unit of the first embodiment.

Referring to FIGS. 2 and 3, the electrical heating tray unit 3 includes a heating tray 31, an upper lid 32 covering a top side of the heating tray 31 and an electrical heating tube 33 disposed in the heating tray 31. The heating tray 31 has a plate portion 311 which the electrical heating tube 33 is embedded in and secured to, and a plurality of spaced-apart tray walls 313 extending from a top surface of the plate portion 311. The upper lid 32 cooperatively defines the upper vaporization chamber 30 with the plate portion 311 and the tray walls 313 of the electrical heating tray 31.

The upper lid 32 is formed with a water inlet 320 extending therethrough for introduction of water into the upper vaporization chamber 30. The plate portion 311 has a discharge port 312 for discharge of vapor from the upper vaporization chamber 30. The upper vaporization chamber 30 has a heating region 301 extending along a longitudinal direction (i.e., a front-rear direction) of the heating tray 31 and having one end connected to the water inlet 320, and a main vaporization region 302 extending and connected between another end of the heating region 301 and the discharge port 312. Specifically, the heating region 301 extends in a serpentine manner along the front-rear direction. The main vaporization region 302 is connected to a rear end of the heating region 301 and extends forwardly following a V-shaped path along left and right sides of the heating region 301 at positions spaced apart from the heating region 301. The electrical heating tube 33 also has a V-shaped configuration and extends along underneath the main vaporization region 302. As such, the heating region 301 guides water from the water inlet 320 rearwardly to the main vaporization region 302. The water then flows forwardly along the main vaporization region 302. The electrical heating tube 33 is able to generate heat from electricity flowing therethrough so as to heat and increase the temperature of water in the heating region 301 and to quickly vaporize water in the main vaporization region 302.

Figure 4:
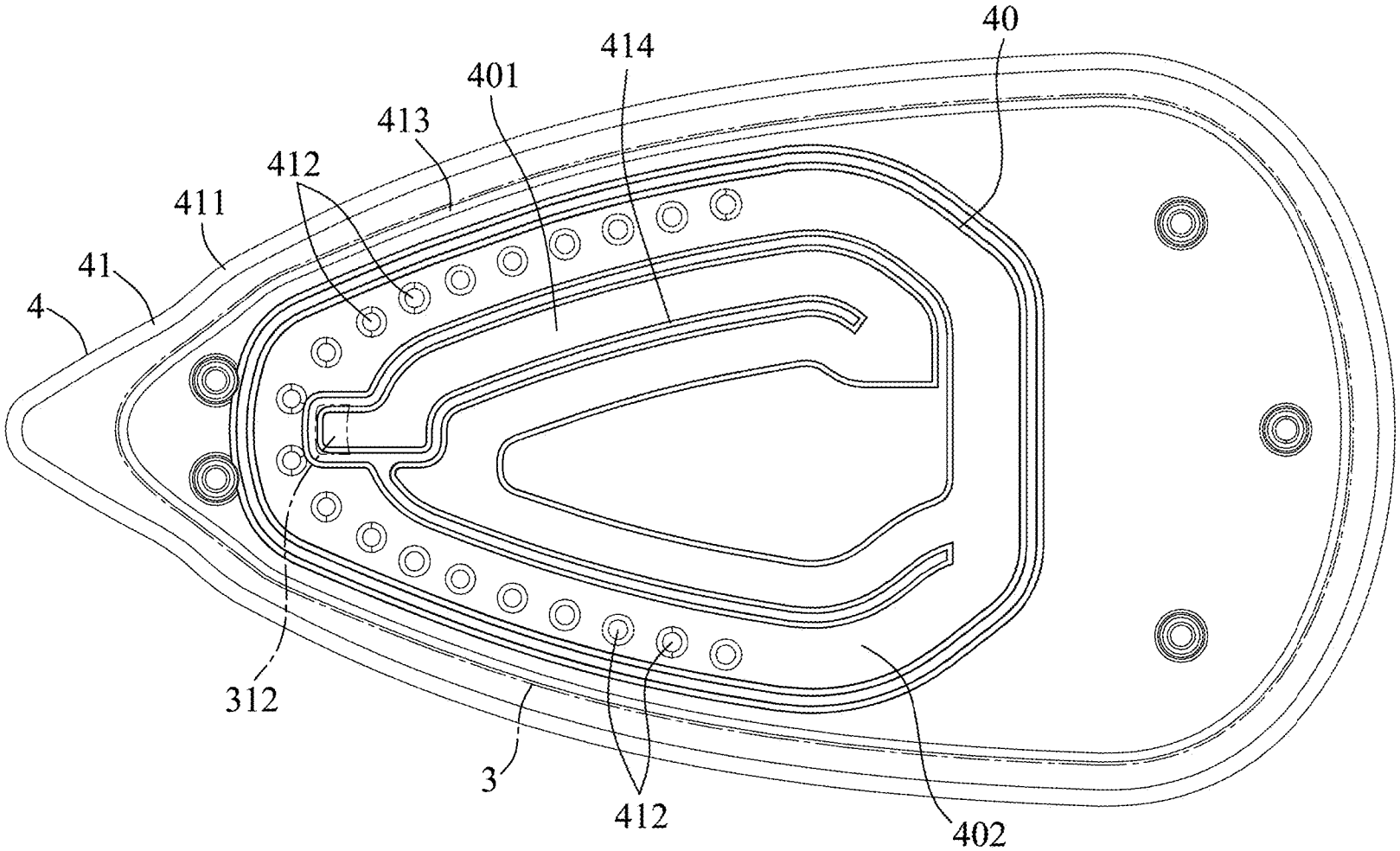
FIG. 4 is a top view of the soleplate unit of the first embodiment.
Figure 5:
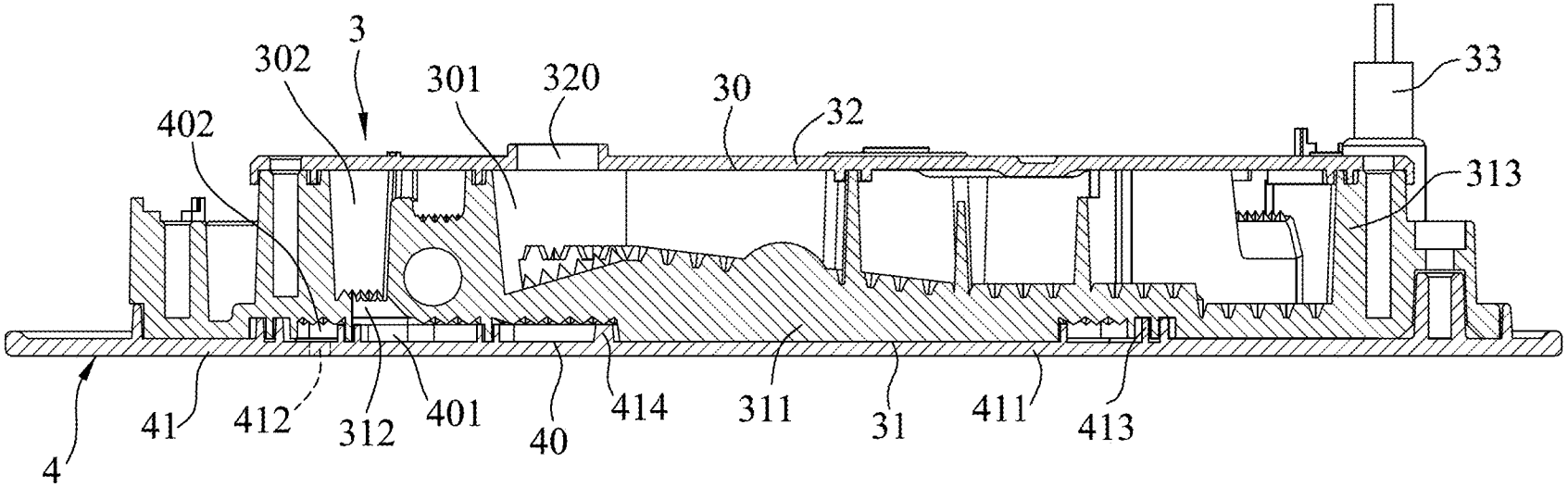
FIG. 5 is sectional view of the electrical heating tray unit and the soleplate unit of the first embodiment in a stack.

Referring to FIGS. 2, 4 and 5, the soleplate unit 4 includes a soleplate 41 mounted to and heated by the electrical heating tray unit 3. Specifically, the heating tray 31 is stacked on the soleplate 41. The soleplate 41 has a plate body 411 for ironing clothing, a surrounding wall portion 413, and a guiding wall portion 414. The surrounding and guiding wall portions 413, 414 are spaced apart from each other, and protrude from a top side of the plate body 411 to abut against the electrical heating tray unit 3. The surrounding wall portion 413, the plate body 411, and the electrical heating tray unit 3 cooperatively define a lower vaporization chamber 40 in communication with the discharge port 312 of the electrical heating tray unit 3. The plate body 411 is formed with a plurality of vapor outlets 412 extending through a bottom surface thereof for outletting vapor from the lower vaporization chamber 40. The guiding wall portion 414 divides the lower vaporization chamber 40 into an auxiliary vaporization region 401 communicated with the discharge port 312, and a vapor release region 402 connected between the auxiliary vaporization region 401 and the vapor outlets 412. Specifically, the auxiliary vaporization region 401 is serpentine and has two ends respectively connected to the discharge port 312 of the electrical heating tray unit 3 and the vapor release region 402, which allows vapor exiting the discharge port 312 to be continually heated to remain in the vapor state. The vapor release region 402 is spaced apart from and surrounds the auxiliary vaporization region 401. One end of the vapor release region 402 is connected to the auxiliary vaporization region 401. The vapor outlets 412 are arranged along the vapor release region 402.

Referring to FIGS. 2, 4, and 5, when the steam type clothing flattening device 200 is under operation, the electrical heating tray unit 3 is heated electrically to vaporize water in the upper vaporization chamber 30 thereof. Water enters the upper vaporization chamber 30 via the water inlet 320 and is heated as it flows along the heating region 301. The heated water is quickly vaporized as it flows into the main vaporization region 302. Vapor produced in the main vaporization region 302 enters the lower vaporization chamber 40 via the discharge port 312. The vapor that enters the lower vaporization chamber 40 first moves through the auxiliary vaporization region 401 and continues to be heated by the heat generated by the electrical heating tube 33. The high temperature vapor then enters the vapor release region 402 and is released from the steam type clothing flattening device 200 via the vapor outlets 412 to come into contact with clothing to be ironed.

As the electrical heating tube 33 is able to heat both the upper and lower vaporization chambers 30, 40, the heat energy of the electrical heating tube 33 is effectively utilized to produce a relatively large amount of vapor and to continually keep the vapor at a high temperature in spite of the large vapor amount which allows the vapor to better penetrate clothing. The problem of water dripping out of the steam type clothing flattening device 200 due to an increase in vapor volume is further resolved.

Figure 6:
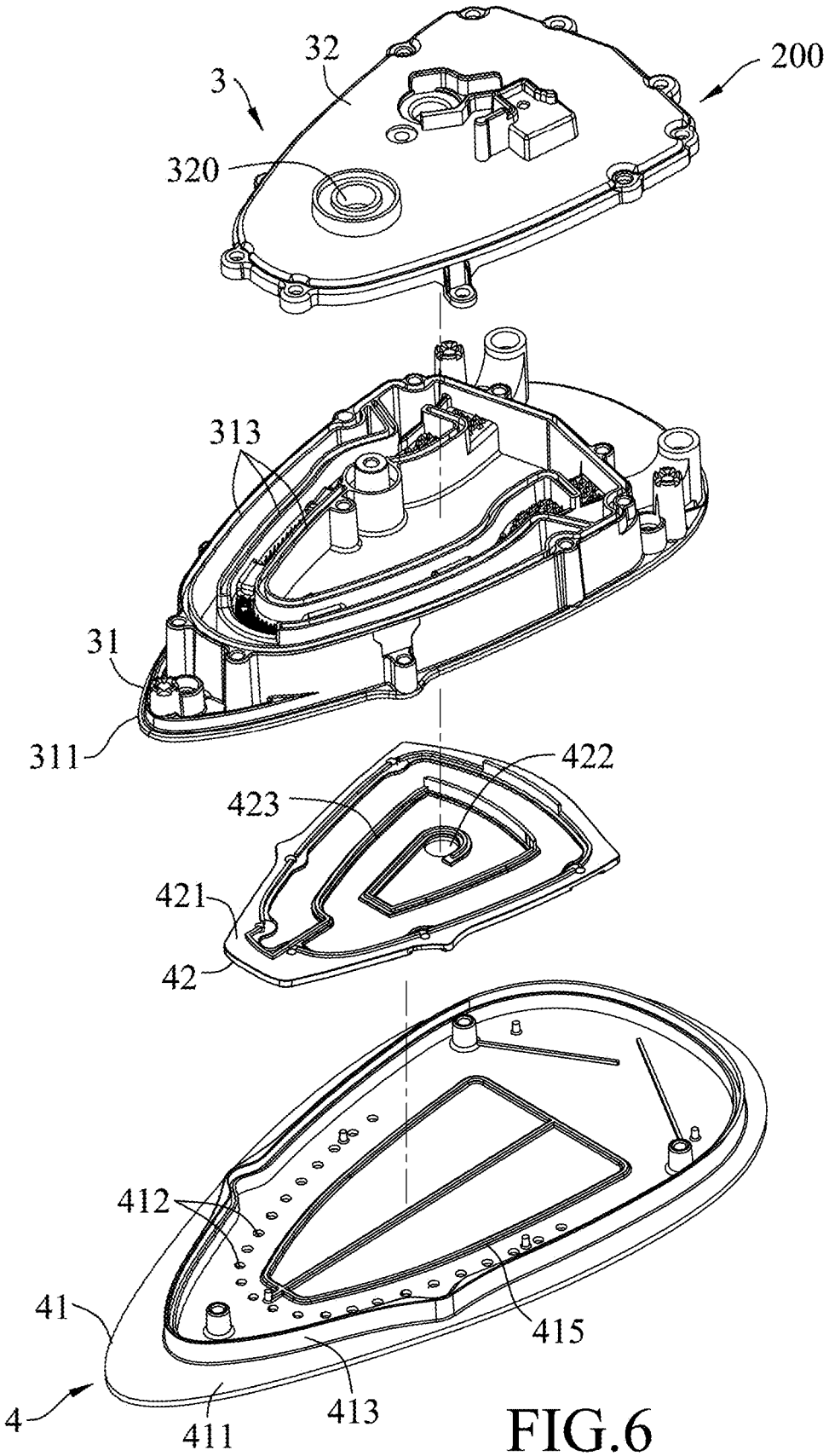
FIG. 6 is an exploded view illustrating an electrical heating tray unit and a soleplate unit of a second embodiment of the steam type clothing flattening device according to the disclosure.
Figure 7:
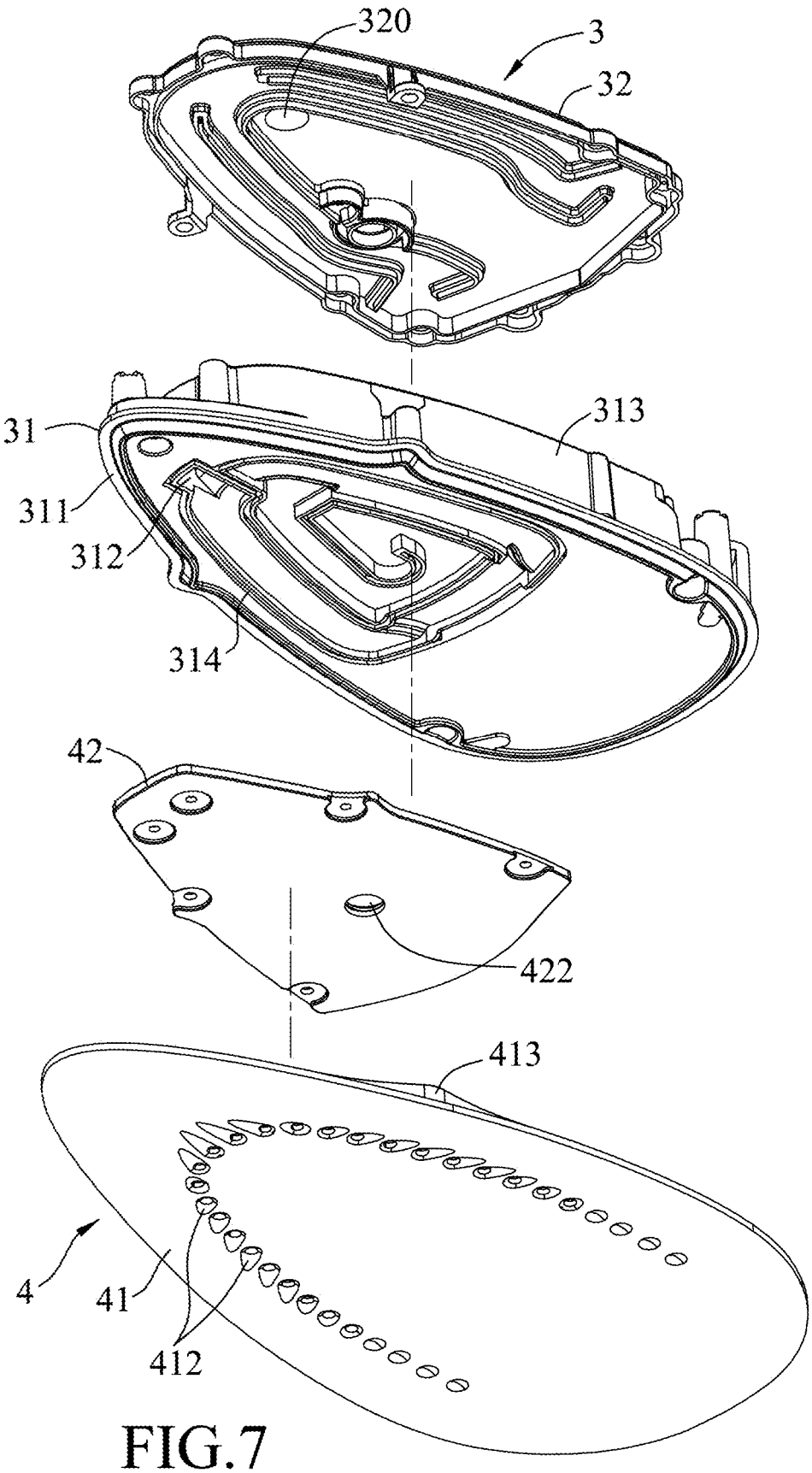
FIG. 7 is another exploded view that illustrates the electrical heating tray unit and the soleplate unit of the second embodiment and that is viewed from an angle different from FIG. 6.
Figure 8:
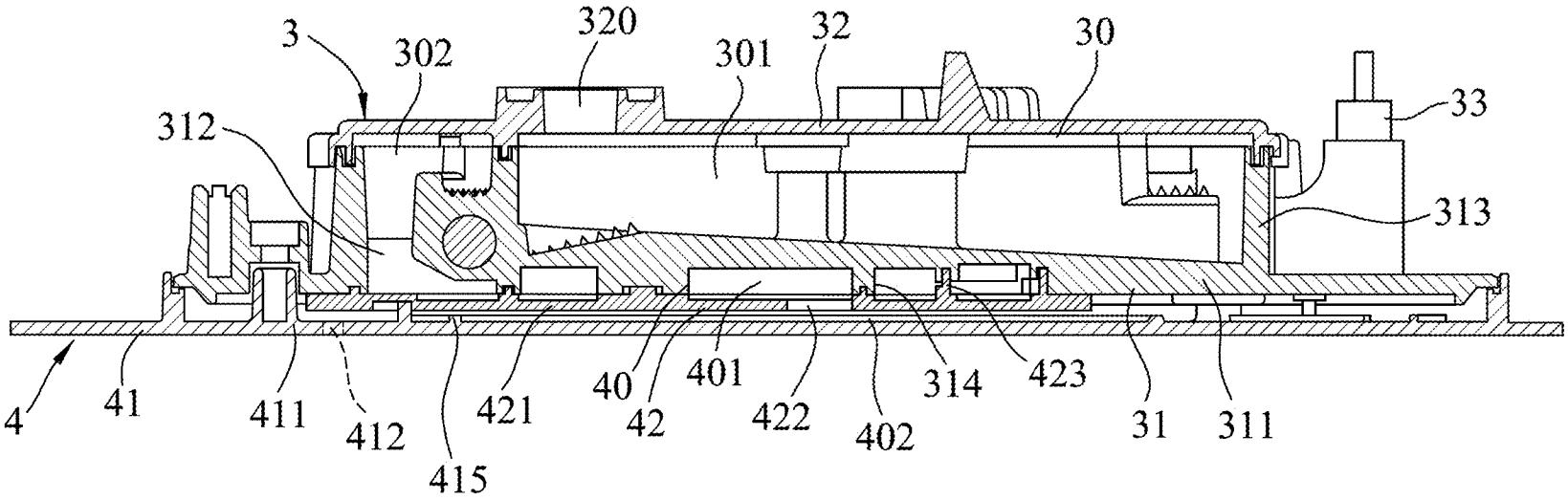
FIG. 8 is a sectional view of the electrical heating tray unit and the soleplate unit of the second embodiment in a stack.

Referring to FIGS. 6, 7, and 8, a second embodiment of the steam type clothing flattening device 200 is similar to the first embodiment, but has the differences described below.

The heating tray 31 further has a bottom rib 314 extending in a serpentine manner, and protruding from a bottom of the plate portion 311 of the heating tray 31.

The guiding wall portion 414 of the soleplate 41 is omitted, and the soleplate 41 further has an elevating wall portion 415 protruding from the top surface of the plate body 411 and spaced apart from the surrounding wall portion 413. The vapor outlets 412 are arranged surrounding the elevating wall portion 415.

The soleplate unit 4 further includes a lower lid 42 disposed between the elevating wall portion 415 of the soleplate 41 and the heating tray 31 in a stack. The lower lid 42 divides the lower vaporization chamber 40 into the auxiliary vaporization region 401 and the vapor release region 402. The lower lid 42 has a plate-shaped lid body 421 and a flow guide rib 423. The plate-shaped lid body 421 is stacked on top of elevating wall portion 415 of the soleplate 41 and formed with a connecting hole 422 extending through top and bottom surfaces of the plate-shaped lid body 421 of the lower lid 42. The flow guide rib 423 extends in a serpentine manner, and protrudes upwardly from a top side of the plate-shaped lid body 421 of the lower lid 42 to mate with the bottom rib 314 of the heating tray 31. In this embodiment, the auxiliary vaporization region 401 is communicated with the discharge port 312 of the electrical heating tray unit 3 and the connecting hole 422 of the lower lid 42, and the vapor release region 402 is connected between the connecting hole 422 and the vapor outlets 412. Specifically, the auxiliary vaporization region 401 is serpentine and has two ends respectively connected to the discharge port 312 of the electrical heating tray unit 3 and the connecting hole 422 of the lower lid 42.

When the steam type clothing flattening device 200 of the second embodiment is under operation, water enters the upper vaporization chamber 30 via the water inlet 320 and is heated as it flows along the heating region 301. The heated water is quickly vaporized as it flows into the main vaporization region 302. Vapor produced in the main vaporization region 302 flows downward into the lower vaporization chamber 40, moving through the auxiliary vaporization region 401 and being continually heated by the heat generated by the electrical heating tube 33. The high temperature vapor then enters the vapor release region 402 and is released from the steam type clothing flattening device 200 via the vapor outlets 412 to come into contact with clothing to be ironed.

In the second embodiment, the bottom rib 314 of the heating tray 31 mates with the flow guide rib 423 of the lower lid 42 for cooperatively surrounding the auxiliary vaporization region 401 of the lower vaporization chamber 40. However, as an alternative, the bottom rib 314 may be arranged to abut directly against the top surface of the lower lid 42, or the flow guide rib 423 may be arranged to abut directly against the bottom surface of the heating tray 31 to surround the auxiliary vaporization region 401.

Figure 9:
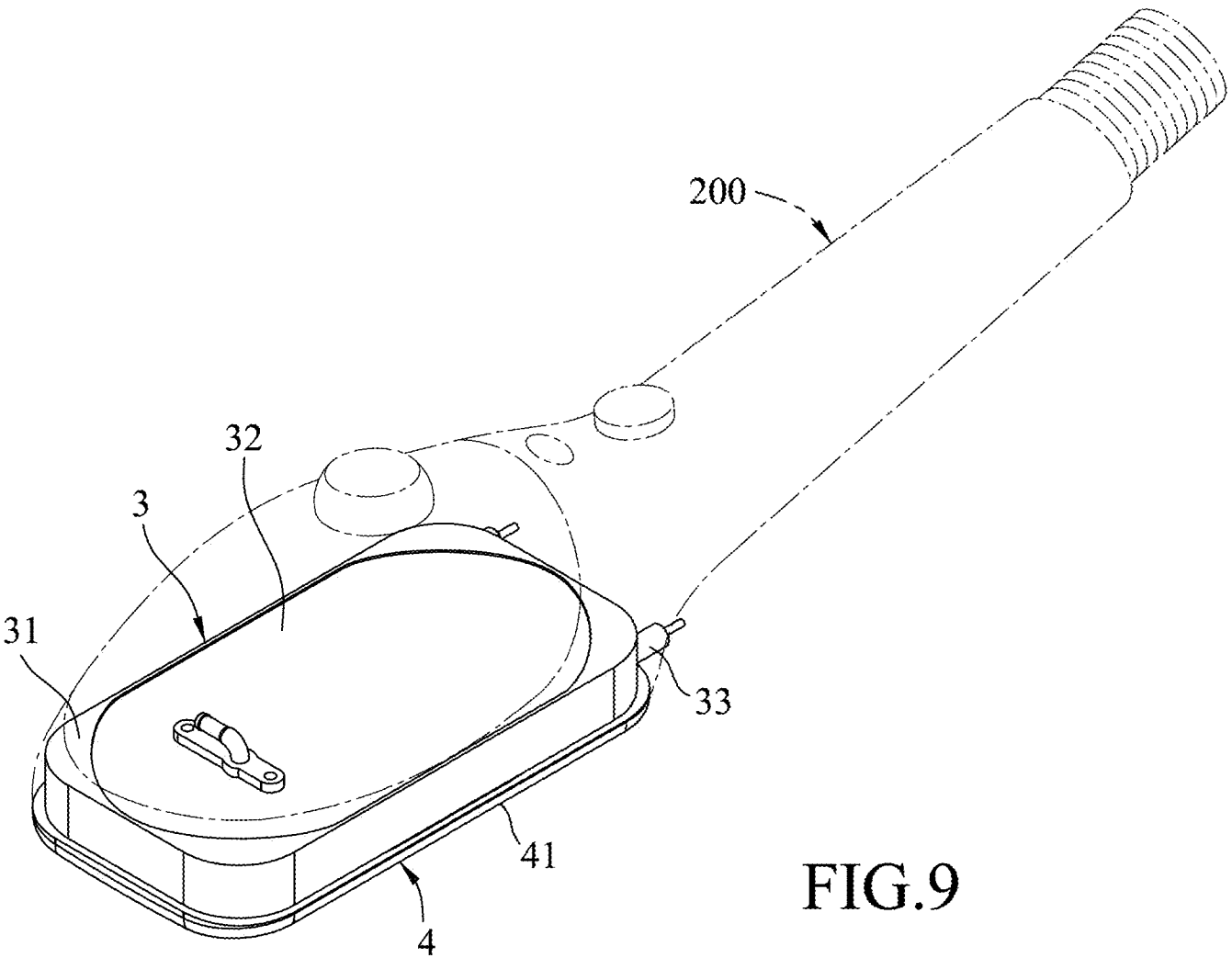
FIG. 9 is a schematic view of a third embodiment of the steam type clothing flattening device according to the disclosure.
Figure 10:
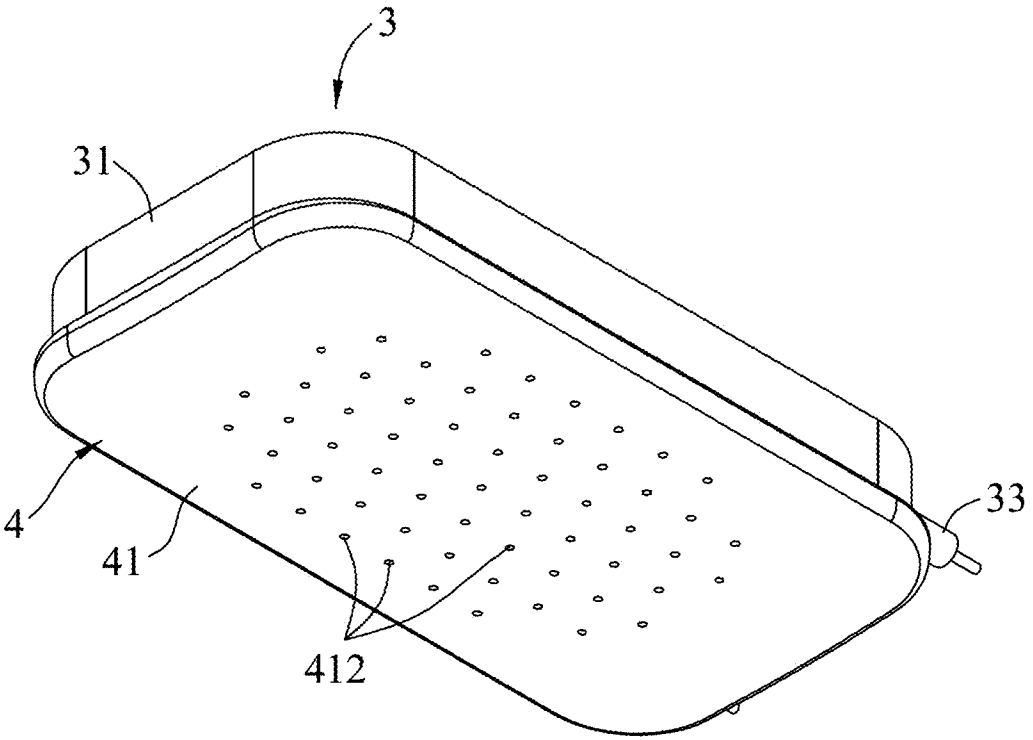
FIG. 10 is a perspective view of an electrical heating tray unit and a soleplate unit of the third embodiment.

Referring to FIGS. 9 and 10, a third embodiment of the steam type clothing flattening device 200 is shown, wherein the steam type clothing flattening device 200 is exemplified as a steam brush. Interior structures of the steam brush include the electrical heating tray unit 3 and the soleplate 4 which may be similar to those of the first or second embodiments. In use, the steam brush is placed in proximity to hanged clothing to apply stream thereto and to smooth creases on the clothing.

In sum, the electrical heating tray unit 3 and the soleplate unit 4 of this disclosure cooperatively defines the upper and lower vaporization chambers 30, 40, and the electrical heating tube 33 is disposed to simultaneously heat water/vapor in both the upper and lower vaporization chambers 30, 40 for producing a relatively large volume of vapor without the need of increasing the number of electrical heating tubes 33. Moreover, by provision of the lower vaporization chamber 40, the issue of water drops formation is resolved.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A steam type clothing flattening device comprising:

an electrical heating tray unit heated electrically to vaporize water in an upper vaporization chamber thereof, and having a discharge port for discharge of vapor from said upper vaporization chamber; and a soleplate unit coupled to an underside of and heated by said electrical heating tray unit, said soleplate unit cooperating with said electrical heating tray unit to define a lower vaporization chamber which is in communication with said discharge port, and having a plurality of vapor outlets that extend through a bottom surface thereof for outletting vapor from said lower vaporization chamber;

wherein said soleplate unit includes a soleplate mounted beneath said electrical heating tray unit in a stack, and a lower lid disposed between said soleplate and said electrical heating tray unit in a stack;

wherein said soleplate and said electrical heating tray unit cooperatively define said lower vaporization chamber;

wherein said lower lid has a connecting hole extending through top and bottom surfaces of said lower lid, and divides said lower vaporization chamber into an auxiliary vaporization region communicated with said discharge port of said electrical heating tray unit and said connecting hole, and a vapor release region connected between said connecting hole and said vapor outlets; and wherein said lower lid further has a plate-shaped lid body stacked on top of said soleplate and being formed with said connecting hole, and a flow guide rib extending in a serpentine manner, and protruding upwardly from a top side of said plate-shaped lid body to abut against said electrical heating tray unit for surroundingly defining said auxiliary vaporization region of said lower vaporization chamber.

2. The steam type clothing flattening device as claimed in claim 1, wherein said auxiliary vaporization region of said lower vaporization chamber is serpentine and has two ends respectively connected to said discharge port of said electrical heating tray unit and said connecting hole of said lower lid.

3. The steam type clothing flattening device as claimed in claim 2, wherein:

said electrical heating tray unit includes a heating tray disposed above said lower lid and said soleplate in a stack, an upper lid covering a top side of said heating tray and cooperatively defining said upper vaporization chamber with said electrical heating tray, and an electrical heating tube disposed in said heating tray and able to generate heat from electricity flowing therethrough; and said heating tray has a bottom rib extending in a serpentine manner, and protruding from a bottom of said heating tray to mate with said flow guide rib of said lower lid for cooperatively surrounding said auxiliary vaporization region of said lower vaporization chamber.

4. The steam type clothing flattening device as claimed in claim 3, wherein:

said upper lid is formed with a water inlet extending therethrough for introduction of water into said upper vaporization chamber; and said upper vaporization chamber has a heating region extending along a longitudinal direction of said heating tray and having an end connected to said water inlet, and a main vaporization region extending and connected between another end of said heating region and said discharge port.

5. A steam type clothing flattening device comprising:

an electrical heating tray unit heated electrically to vaporize water in an upper vaporization chamber thereof, and having a discharge port for discharge of vapor from said upper vaporization chamber; and a soleplate unit coupled to an underside of and heated by said electrical heating tray unit, said soleplate unit cooperating with said electrical heating tray unit to define a lower vaporization chamber which is in communication with said discharge port, and having a plurality of vapor outlets that extend through a bottom surface thereof for outletting vapor from said lower vaporization chamber;

wherein said soleplate unit includes a soleplate mounted beneath said electrical heating tray unit in a stack, and a lower lid disposed between said soleplate and said electrical heating tray unit in a stack;

wherein said soleplate and said electrical heating tray unit cooperatively define said lower vaporization chamber;

wherein said lower lid has a connecting hole extending through top and bottom surfaces of said lower lid, and divides said lower vaporization chamber into an auxiliary vaporization region communicated with said discharge port of said electrical heating tray unit and said connecting hole, and a vapor release region connected between said connecting hole and said vapor outlets;

wherein said electrical heating tray unit includes a heating tray disposed above said lower lid and said soleplate in a stack, an upper lid covering a top side of said heating tray and cooperatively defining said upper vaporization chamber with said electrical heating tray, and an electrical heating tube disposed in said heating tray and able to generate heat from electricity flowing therethrough; and wherein said heating tray has a bottom rib extending in a serpentine manner and protruding from a bottom of said heating tray to abut against said lower lid for surrounding said auxiliary vaporization region of said lower vaporization chamber.

6. The steam type clothing flattening device as claimed in claim 5, wherein:

said upper lid is formed with a water inlet extending therethrough for introduction of water into said upper vaporization chamber; and said upper vaporization chamber has a heating region extending along a longitudinal direction of said heating tray and having an end connected to said water inlet, and a main vaporization region extending and connected between another end of said heating region and said discharge port.

* * * * *